United States Patent [19]

Tashman

[11] 4,138,953

[45] Feb. 13, 1979

[54] ADJUSTABLE SHELF ASSEMBLY

[76] Inventor: Philip Tashman, 11020 SW. 75th Ct., Miami, Fla. 33156

[21] Appl. No.: 833,761

[22] Filed: Sep. 16, 1977

[51] Int. Cl.[2] ..... A47B 9/00

[52] U.S. Cl. ..... 108/144; 248/188

[58] Field of Search ..... 108/107, 110, 111, 144; 248/188

[56] References Cited

U.S. PATENT DOCUMENTS

| | | | |
|---|---|---|---|
| 2,669,496 | 2/1954 | Puls et al. | 248/188 |
| 3,344,756 | 10/1967 | Kelson | 248/188 X |
| 3,424,111 | 1/1969 | Maslow | 108/144 |
| 3,523,508 | 8/1970 | Maslow | 108/144 |
| 3,604,369 | 9/1971 | Maslow | 108/144 |
| 3,675,598 | 7/1972 | Kesilman et al. | 108/144 |
| 3,757,705 | 9/1973 | Maslow | 108/144 |
| 3,874,511 | 4/1975 | Maslow | 108/144 X |
| 3,915,101 | 10/1975 | Onori | 108/111 |

FOREIGN PATENT DOCUMENTS

| | | | |
|---|---|---|---|
| 146332 | 5/1952 | Australia | 248/188 |

*Primary Examiner*—James C. Mitchell

*Attorney, Agent, or Firm*—Ernest H. Schmidt

[57] ABSTRACT

A shelving assembly with rectangular, formed sheet metal shelves horizontally supported by tubular corner posts has molded snythetic plastic corner block members operative to releasably grip any one of a plurality of peripheral zones spaced along the support posts for selective shelf height adjustment. Each sheet metal shelf is formed with a peripheral skirt terminating in a horizontally inwardly-extending flange portion and vertical corner cut-out portions defining together recesses for receiving the individual corner blocks in close-fitting embracing, relation, the corner blocks also being formed, at outside corners thereof, with vertically-extending, rounded projections receivable in the said skirt cut-out portions to define with said peripheral skirt, flush, rounded corner surfaces. A tapered, vertically-extending opening in each corner block slidingly receives a complementary split-ring taper lock retainer having a cylindrical opening for the reception of a tubular corner post, said split-ring taper lock having an internal, peripheral bead adapted to engage any one of a plurality of complementary grooves spaced along the corner posts for selective shelf height adjustment.

4 Claims, 8 Drawing Figures

Fig. 1
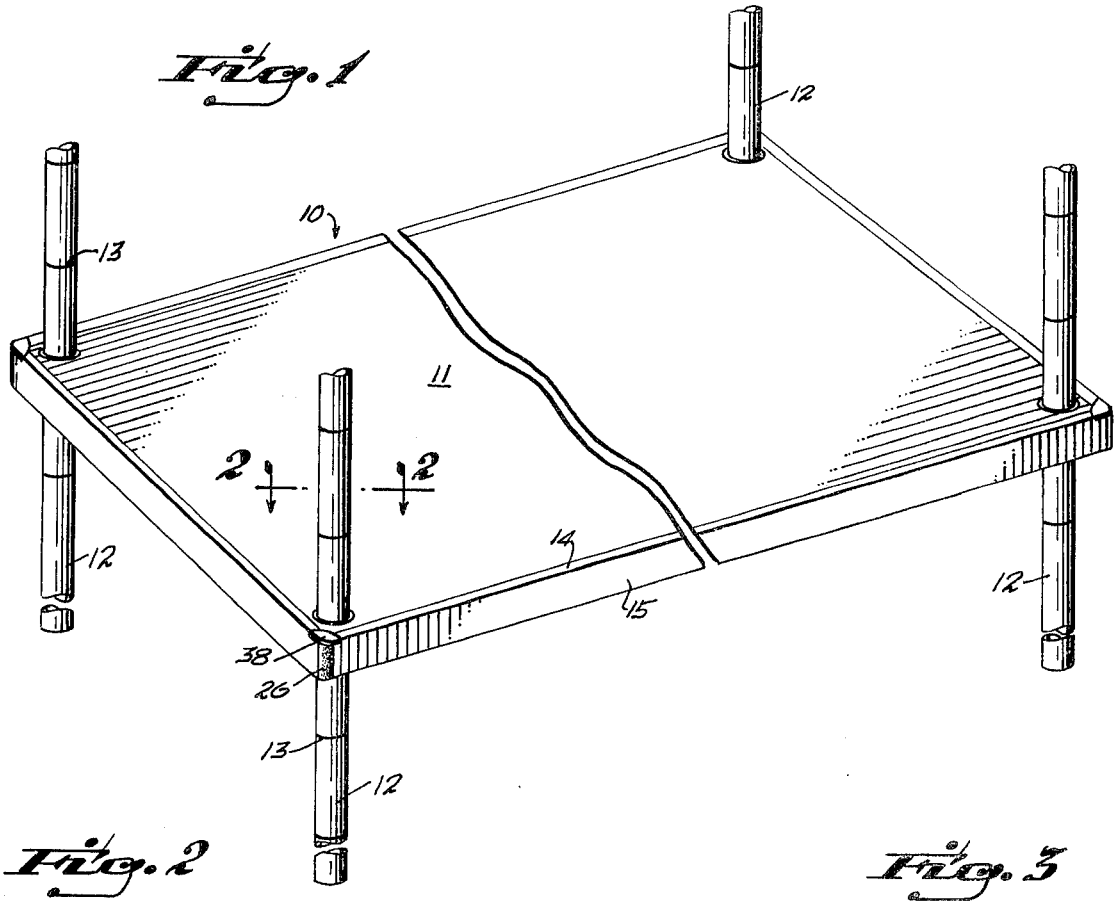
Fig. 2
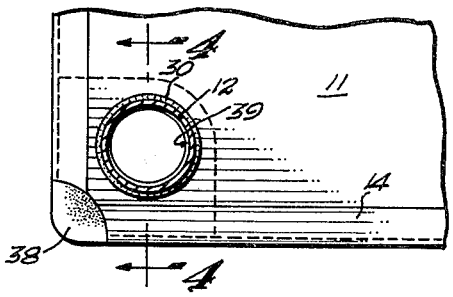
Fig. 3
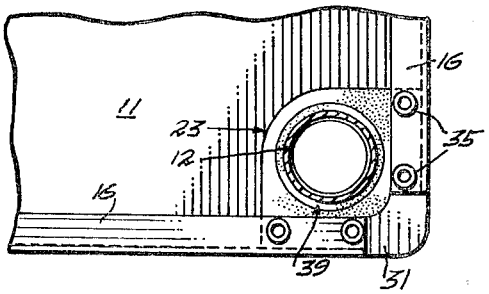
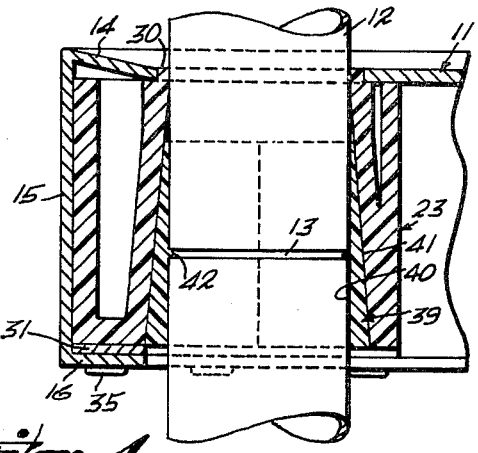
Fig. 4
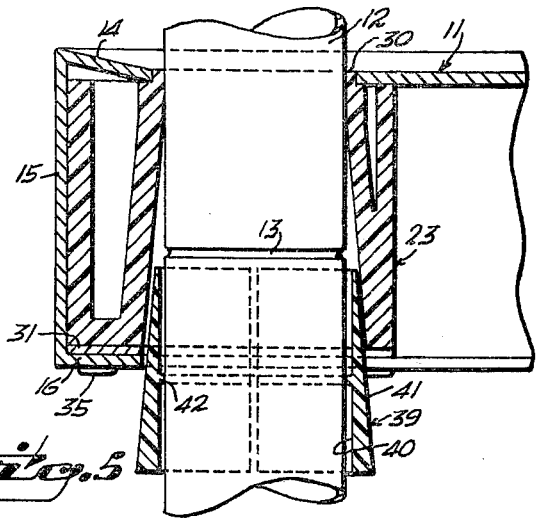
Fig. 5

ADJUSTABLE SHELF ASSEMBLY

This invention relates generally to shelving, and is directed more particularly to formed sheet metal shelving the shelves of which are adjustably securable along supporting corner posts at various spaced positions therealong.

Adjustable metal shelving, often referred to as "knock-down" metal shelving, is known. In such shelving, various devices are utilized for selectedly positioning corner portions of the shelves along vertically extending corner posts for changing the spacing between the shelves. This invention is directed to improvements in the contructional details of such shelving, particularly with respect to the releasable post attachment mechanism.

It is the principal object of this invention to provide a new and improved adjustable shelf assembly of the character described wherein the shelves are formed of sheet metal and wherein the support post securing mechanism at each corner is fully enclosed to facilitate cleaning and for esthetic purposes.

A more particular object of the invention is to provide an adjustable shelf assembly of the above nature which is particularly well suited to fabrication of sheet stainless steel or the like sheet metal suitable for use in the food service industry.

Yet another object of the invention is to provide adjustable shelving of the character described the shelves of which are smooth surfaced and substantially devoid of surface irregularities, crevices and the like in which food particles might otherwise lodge.

Still another object of the invention is to provide an adjustable shelf assembly wherein the shelf supporting posts are of tubular or cylindrical form, and wherein the releasable securing mechanism at each shelf corner comprises relatively slideable and engageable taper lock members integrally formed of a synthetic plastic having a low co-efficient of sliding friction to facilitate gripping and releasing action of the associated shelves with respect to their supporting posts.

Still another object of the invention is to provide an improved adjustable shelf assembly of the above nature wherein the sheet metal shelves are each formed with a downwardly-extending, peripheral skirt terminating in an inwardly-extending, peripheral flange defining together corner zones in which the post securing mechanisms are received from the inside.

Yet another object is to provide a shelf assembly which will be simple in construction, economical to manufacture, easy to manipulate for shelf height adjustment, which can readily be cleaned and sanitized, and which will be attractive in appearance and durable in use.

Other objects, features and advantages of the invention will be apparent from the following description when read with reference to the accompanying drawings. In the drawings, wherein like reference numerals denote corresponding parts throughout the several views:

FIG. 1 is a fragmentary, oblique view of adjustable metal shelving embodying the invention;

FIG. 2 is a fragmentary plan view, seen from above as indicated by the plane 2—2 in FIG. 1, at one corner of the shelf and corner post assembly;

FIG. 3 is a fragmentary view as illustrated in FIG. 2 but as seen from the underside;

FIG. 4 is a vertical cross-sectional view taken along the line 4—4 of FIG. 2 in the direction of the arrows and illustrating constructural details of the interlocking mechanism securing the shelf at a selected position along one of the corner support posts;

FIG. 5 is a cross-sectional view similar to that of FIG. 4 but illustrating disengagement of the shelf from its associated taper lock retainer member to permit adjustable positioning of the shelving along the vertical supporting posts;

Figure 6:
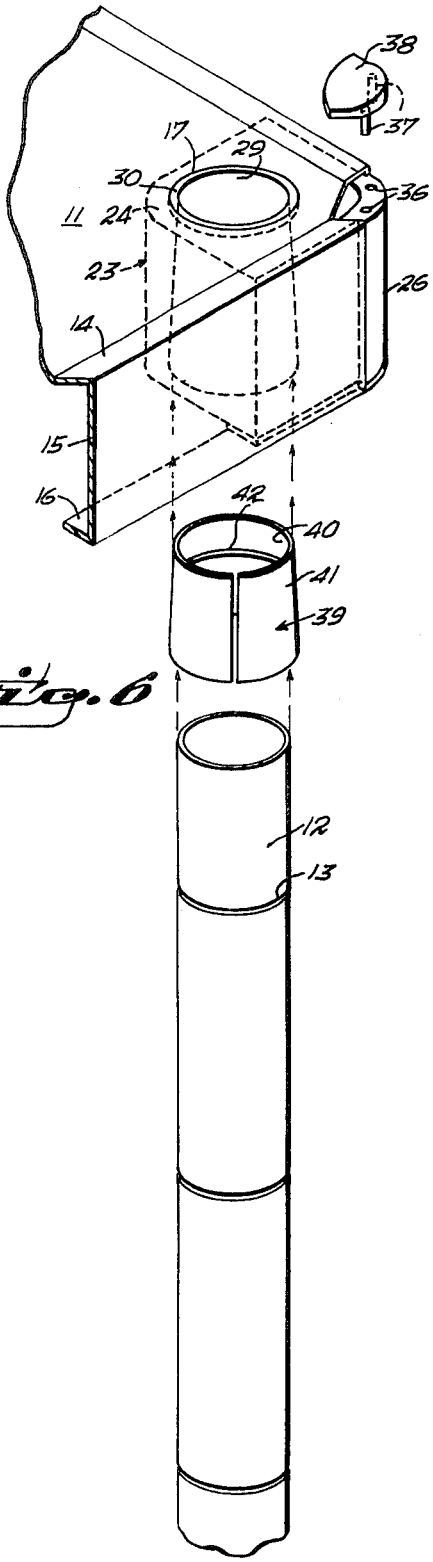
FIG. 6 is an oblique, exploded view, as seen from above, of the corner portion of shelf and post assembly, illustrating constructional details thereof and their interfitting relation.

Referring now in detail to the drawings, reference numeral 10 designates, generally, an adjustable shelf assembly embodying the invention, the same comprising a rectangular shelf member 11 adjustably supported along four tubular corner posts 12. Although only one shelf 11 is illustrated in FIG. 1, it is to be understood that the shelf assembly in practical application will include a plurality of shelf members 11, individually adjustable up and down the corner posts in the manner hereinafter described, whereby said four posts will be maintained in relatively fixed, parallel disposition. The tubular metal corner posts 12 are each provided with a plurality of positioning grooves 13, which will preferably be uniformly spaced therealong in four inch increments, for example, at which positions the shelf members 11 can be secured in the manner and by the means hereinafter described.

Figure 7:
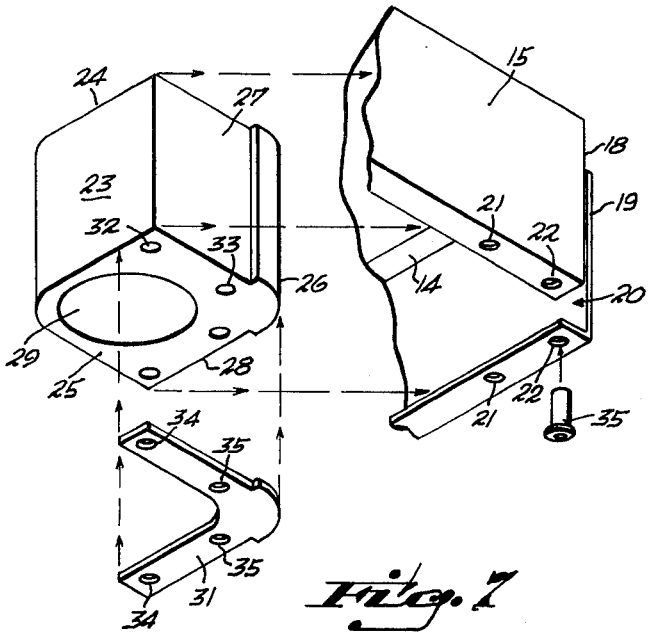
FIG. 7 illustrates, in oblique view as seen from below, a fragmentary corner portion of the metal shelf and its associated corner block member and reinforcement corner plate, and their interfitting relation.
Figure 8:
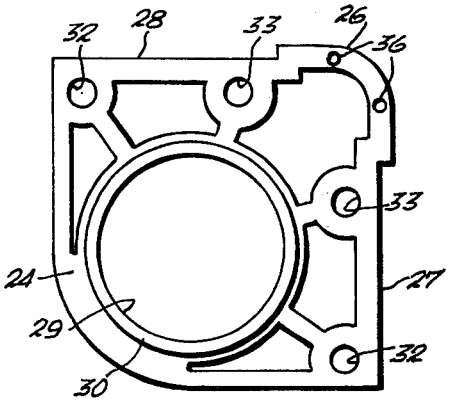
FIG. 8 is a top plan view of the corner block member illustrated in FIG. 7, shown separately and in an enlarged scale.

As best illustrated in FIGS. 1, 6 and 7, the shelf member 11 is formed of sheet metal, preferably stainless steel, and comprises a marginal, slightly upwardly-bent portion 14 merging with a vertically downwardly-extending peripheral skirt portion 15 terminating in a right-angular, horizontally inwardly-turned flange portion 16.

As best illustrated in FIGS. 6 and 7, the shelf member 11 is also provided with circular corner openings 17 in the face thereof, and is cut away along vertical lines 18 and 19 in each corner to provide a symmetrical, rectangular opening, indicated at 20 in FIG. 7. As further illustrated in FIG. 7, the inwardly-turned flange portion 16 of the shelf member 11 is also provided, near each of the rectangular openings 20, with a pair of spaced, through openings 21, 22 at each side of said rectangular opening, for the purpose hereinafter described.

Means is provided at each corner of the shelf member 11 for the sliding reception of one of the corner posts 12 and selective interlocking engagement therewith at any one of the positioning grooves 13 in the manner to be described. To this end, each shelf corner is fitted with a corner block member 23, which will preferably be molded of a tough synthetic plastic material such as polypropylene. The corner block members 23 are formed with spaced, parallel, top and bottom faces 24, 25, respectively, and a rounded, outer vertical corner portion 26 the vertical ends of which extend to right-angularly opposed, slightly recessed outer side faces 27, 28. Each corner block member 23 is also formed with a tapered circular through opening 29, increasing slightly in size from top to bottom. The upper end of the tapered circular opening 29 has integrally formed therewith an outwardly projecting annular lip 30.

As illustrated in FIGS. 4, 6 and 7, each corner block member 23 is fitted within a corner of the shelf member 11, being of such shape, as described above, that adjacent skirt portions 15 of said shelf fit flush within the recessed outer side-faces 27, 28 of said corner block. The rounded, vertically-extending corner portions 26 of the corner blocks thereby define smooth, rounded surfaces at each corner of the shelf 11.

As best illustrated in FIG. 4, the overall height of each block member 23, including the height of the annular lip 30, and the size and disposition of said lip, is such that it an be fitted and fits snugly within its associated corner opening 17 to terminate flush with the upper surface of the shelf 11. Moreover, to permit the fitting in place of the block member 23 with the annular lip 30 received through shelf opening 17 from below, the height thereof is such as to leave a space between the bottom face 25 of said block member and the inner surfaces of the inwardly-turned flange portions 16 extending into the associated corner. This space is utilized for the insertion of a reinforcement corner plate 31 of right-angular shape and having an outer peripheral configuration identical with that of the bottom face 29 of block member 23 at the outside corner.

As is best illustrated in face 3, 4, 7 and 8 corner block member 23 is formed, in side portions adjacent shelf skirt portions 15, with vertical through openings 32, 33 in alignment with respective openings 34, 35 in reinforcement corner plate 31, and in alignment with openings 21, 22 in shelf flange portions 16, to provide for the reception of pop rivets 35 (only one illustrated in FIG. 7) for securely assembling the corner block members 23 within the shelf corners.

As illustrated in FIGS. 1, 2 and 6, the upper surface 24 of the corner block member 23 is provided, at the rounded outer corner thereof, with a pair of spaced, blind, vertically-extending cylindrical openings or bores 36 for the reception of attachment pins 37 of an integrally molded corner trim piece 38.

As illustrated in FIGS. 4, 5 and 6, the means provided for the sliding reception of the corner posts and selective interlocking engagement therewith further comprises a split-ring taper lock retainer 39, preferably fabricated of a tough, somewhat resilient, plastic material such as "Nylon." The inner wall 40 of the taper lock retainer 39 is of cylindrical shape, whereas the outer wall 41 is of frusto-conical shape to conform substantially with the tapered circular through opening 29 in the associated corner block member 23. As illustrated in FIG. 6, the inner wall 40 of the split-ring taper lock retainer 39 is integrally formed with an inwardly-projecting, circular, co-axial bead 42 of such size as to be received in interlocking engagement with any one of the peripheral positioning grooves 13 along the associated corner post 12 in the manner and for the purpose hereinafter more particularly described.

FIGS. 4 and 5 best illustrate the interlocking mechanism in each corner of the shelf 11 with the corner posts 12. Release from the interlocked position as illustrated in FIG. 4 is effected simply by pushing the corners of the shelf upwards of their supporting posts to separate the corner block members 23 from their associated split-ring taper lock retainers 39. Such relative displacement of a corner block member 23 permits the associated taper lock retainer 39 to expand radially so that its bead 42 is no longer locked or retained within any one of the positioning grooves 13 of the associated corner posts 12. The taper lock retainer can then readily be manually repositioned at any other locking position afforded by the corner posts positioning grooves 13, while at the same time maintaining sufficient separation from the associated corner block member. When the selected position of shelf height adjustment is reached with taper lock retainer 39, it will be held in position while the shelf to be supported and its associated corner block member 23 is allowed to pass down over the taper lock retainer for clamping it in place with wedge-like action, as illustrated in FIG. 4. Because of such wedge-like action, it will be apparent that the greater the weight placed upon the shelf, the greater will be the interlocking attachment of the shelf at the corners to the supporting corner posts 12. At the same time, because of the relatively low sliding coefficient of friction of the taper lock retainer 39, no difficulty will be experienced in releasing the mechanism with an upward push at the shelf corners.

While I have illustrated and described herein only one form in which my invention can conveniently be embodied in practice, it is to be understood that this embodiment is given by way of example only and not in a limiting sense.

My invention, in brief, comprises all the embodiments and modifications coming within the scope and spirit of the following claims:

I claim:

1. An adjustable shelf assembly comprising, in combination, a rectangular formed sheet metal shelf having a flat horizontal supporting surface and a peripheral, right-angularly down-turned skirt portion terminating in a comparatively short, in-turned flange portion, four corner posts having cylindrical outer surfaces, a synthetic plastic corner block member at each corner of said rectangular shelf and embraced by the underside thereof, said down-turned skirt portion and said in-turned flange portion, each of said corner block members having a circular, tapered, through opening coaxial with a circular opening in said flat supporting surface of said shelf for the reception therethrough of one each of said corner posts, a radially-resilient, split-ring taper lock retainer for each of said corner block members, each having an outer frusto-conical surface conforming with the tapered inner surface of its associated block member and an internal cylindrical surface the diameter of which conforms with the diameter of its associated corner post, a circular bead extending radially inwardly of the internal cylindrical surface of each of said split-ring taper lock retainers, and a plurality of peripheral grooves spaced along each of said corner posts and operative to interfittingly receive the circular beads of one each of said split-ring taper lock retainers, selectively, for securing them in place therealong upon said corner block members being fitted down over their respective taper lock retainers in wedging relation, whereby said shelf can be secured in adjusted position along said corner posts, said circular openings in said shelf supporting surface being of a slightly greater diameter than the internal diameter of said block member through openings at the upper ends thereof, said block members being integrally formed with peripheral, annular lips extending outwardly of the upper end thereof and being of such size as to slidingly fit within one each of said corner openings flush with the upper surface of said horizontal shelf supporting surface, the axial length of each block member being slightly less than the distance between the facing inner surfaces of said horizontal shelf supporting surface and said in-turned flange portion, a flat, right-angular corner plate slidingly receivable between the lower end of each of said block members and said inner surface of said in-turned flange, and means extending through said in-turned flanges and said corner plates for locking said block members in place.

2. An adjustable shelf assembly as defined in claim 1 wherein said flat shelf supporting surface is formed with a marginal, slightly upwardly-bend portion the outer periphery of which merges with said down-turned skirt portion.

3. An adjustable shelf assembly as defined in claim 2 wherein each corner of said shelf is provided with a vertically-extending cut-out portion, said corner blocks being formed with rounded outer corner portions receivable in their respective shelf cut-outs and so shaped as to define smooth, rounded, flush surface portions with the outsides of said peripheral skirt.

4. An adjustable shelf assembly as defined in claim 5 including an integrally molded corner trim piece receivable in an opening at the upper end of one each of said block members and within the opening defined by said cut-out.

* * * * *